United States Patent [19]

Serafini

[11] Patent Number: 4,935,295

[45] Date of Patent: Jun. 19, 1990

[54] NEEDLING PROCESS FOR SPUNDBONDED COMPOSITES

[75] Inventor: Franco L. Serafini, Leudelange, Italy

[73] Assignee: E. I. du Pont de Nemours and Company, Wilmington, Del.

[21] Appl. No.: 278,476

[22] Filed: Dec. 1, 1988

[51] Int. Cl.[5] ..... B32B 5/06; B32B 31/16

[52] U.S. Cl. ..... 428/286; 28/111; 28/112; 156/148; 428/287; 428/296; 428/300

[58] Field of Search ..... 28/112, 111; 428/286, 428/287, 300; 156/148

[56] References Cited

U.S. PATENT DOCUMENTS

| | | | |
|---|---|---|---|
| 2,059,132 | 10/1936 | McDermott | 28/4 |
| 3,546,062 | 12/1970 | Herrman . | |
| 3,670,506 | 6/1972 | Gaudard | 61/35 |
| 3,817,820 | 6/1974 | Smith | 28/112 |
| 3,822,173 | 7/1974 | Graber et al. . | |
| 3,860,472 | 1/1975 | Derville | 156/148 |
| 4,113,535 | 9/1978 | Lefkowitz et al. | 28/112 |
| 4,311,273 | 1/1982 | Marsh | 238/1 |
| 4,582,750 | 4/1986 | Lou et al. | 428/288 |
| 4,612,224 | 9/1986 | Davis | 428/109 |
| 4,617,219 | 10/1986 | Schupack | 428/113 |
| 4,647,497 | 3/1987 | Weeks | 428/284 |

FOREIGN PATENT DOCUMENTS

| | | | |
|---|---|---|---|
| 221336 | 5/1987 | European Pat. Off. | 28/112 |
| 1948553 | 4/1971 | Fed. Rep. of Germany | 28/112 |

OTHER PUBLICATIONS

Radko Krcma, *Nonwoven Textiles*, 1967, pp. 139–149.

*Primary Examiner*—James C. Cannon

[57] ABSTRACT

A process is disclosed for manufacturing a high strength composite structure by needling individual webs of initially spunbonded material and then needle-punching a stack of the individual webs to enmesh and entangle filaments across the webs, with little or no loss of the initial filament-related strength.

8 Claims, 1 Drawing Sheet

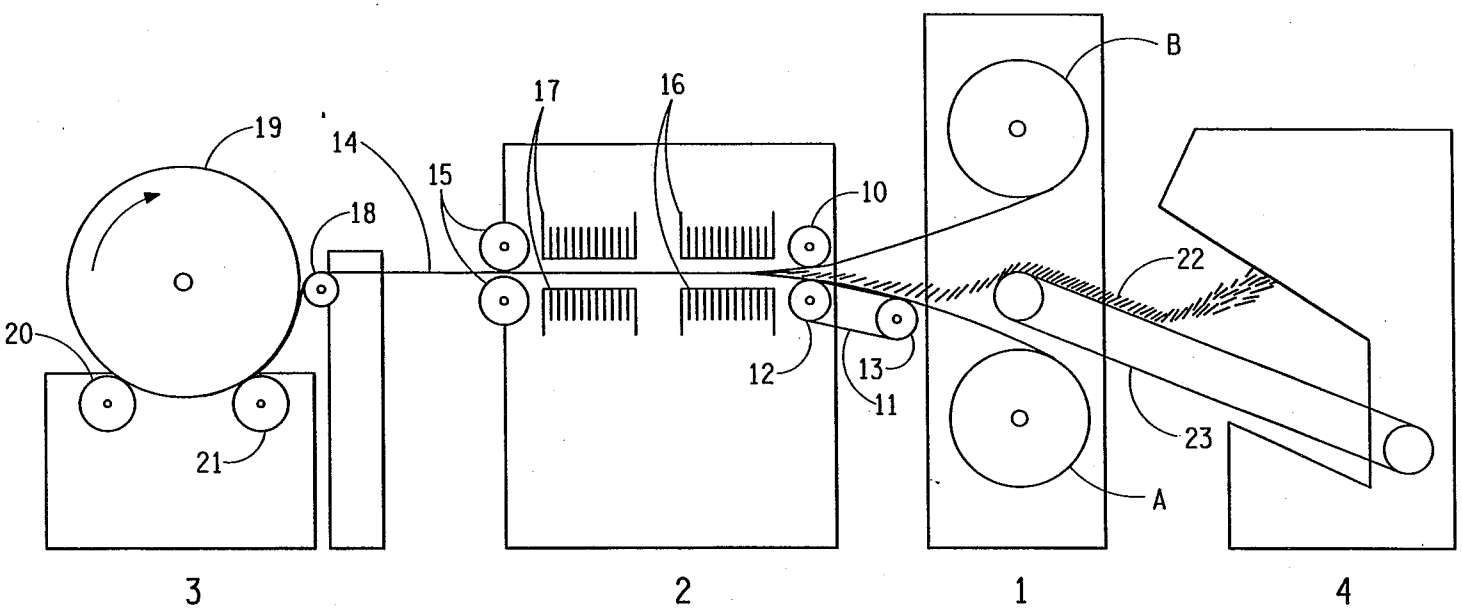
FIGURE

NEEDLING PROCESS FOR SPUNDBONDED COMPOSITES

BACKGROUND OF THE INVENTION

1. Field of the Invention

This invention relates to manufacture of high strength composite structures using layers of initially spunbonded material.

2. Description of the Prior Art

U.S. Pat. No. 4,311,273, issued Jan. 19, 1982 on the application of Ronald P. Marsh, relates to a multi-layer structure of nonwoven sheets wherein adjacent sheets in the structure are joined by means of needle-punching with barbed needles. This reference also discloses needle-punching the individual layers separately in order to increase porosity prior to impregnation with thermosetting resins.

U.S. Pat. No. 3,670,506 issued June 20, 1972 on the application of Yves Gaudard, relates to manufacture of spunbonded structures wherein the exterior surfaces of a thick web of melt spun filaments are calendered hot and then are needle-punched to enmesh the filaments from one surface to the other through the thickness of the structure.

SUMMARY OF THE INVENTION

The present invention provides a process for manufacturing a composite structure of spunbonded layers comprising the steps of applying a finish of lubricating material to coat the filaments of a spunbonded web of synthetic polymer, needling the web of coated filaments using smooth needles to loosen the web and break most of the bonds between the filaments; and, then, placing one or more of the needled webs of coated filaments in a stack and needle-punching the stack with barbed needles to enmesh filaments from the spunbonded webs and yield a composite structure.

There is further provided, a composite structure of spunbonded layers which can be made by the described process and which includes one or more loosened webs of spunbonded polymer filaments wherein the filaments of each web have a coating of a lubricating material and have at least some of the bonds between the filaments broken in order to loosen the web and at least some filaments from each of the loosened webs drawn to another loosened web in order to enmesh the filaments and join the webs without undue filament breakage.

BRIEF DESCRIPTION OF THE DRAWINGS

The FIGURE presents a schematic view of the process of the present invention by means of simplified depictions of the several elements which constitute the apparatus for practicing the invention.

DETAILED DESCRIPTION OF THE INVENTION

Referring to the FIGURE, there is shown a much simplified depiction of the apparatus used for practicing the present invention. Spunbonded webs are supplied from the unwind stand of Section 1, the webs are fed to the needling device of Section 2, and the needled webs are taken up at the windup stand of Section 3. Staple fibers or other optional supplemental material can be added from the carding and crosslapper system of Section 4.

Rolled webs A and B of spunbonded material are mounted on the unwind stand of Section 1. The spunbonded webs can be any of the well-known spunbonded materials including those which are exemplified hereinafter. It is, of course, the case that more than two webs can be used; and it is, also, the case that a single web can be used in practice of this invention.

The needling device of Section 2 can be fitted with feed roll 10 which forms a nip with feed belt 11 supported by rolls 12 and 13. Web materials 14 are drawn into Section 2 by the nip between roll 10 and belt 11 and are drawn out of Section 2 by the nip roll pair 15. While present in Section 2, web materials 14 are subjected to loosening by smooth needle elements 16 and to enmeshing by barbed needle elements 17.

Spunbonded material 14, completely enmeshed in accordance with this invention, is passed over support roll 18 and wound into product roll 19 by winding rolls 20 and 21 on the windup stand of Section 3.

If it is desired or required for a particular purpose, staple fibers or other supplemental materials can be added to the spunbonded webs from preparation and addition devices in Section 4 such as carding and crosslapping devices. If staple is to be added, the staple 22 is carded and crosslapped and laid on transport belt system 23 on which it is carried until it is dropped onto the spunbonded web from roll A. The staple 22, is thereafter, carried on the web from roll A, through the filament loosening step of the smooth needles and the filament enmeshing step of the barbed needles and the staple and other additive materials, thereby, becoming an integral element of the resulting composite whether one or two or more spunbonded webs are used.

In manufacture of heavy weight spunbonded sheeting on the order of 200 grams per square meter or more, there is often a need to combine at least two sheets of lighter weight. Furthermore, it is often desired to manufacture composite sheets having outer layers of spunbonded materials which envelope other materials on the inside.

Individual layers of randomly melt spun sheeting are often combined by a process called needle-punching wherein needles having small barbs are pushed through the layers to be combined. In the needle-punching stroke, the barbs carry individual filaments and, thereby, cause an entanglement or enmeshment of filaments between the sheeting layers. A more detailed description of needle-punching can be found in U.S. Pat. No. 2,059,132.

Until the present invention, sheets which were spunbonded and treated to have significant filament-to-filament bonding could not be needle-punched to afford a strong adhesion without breaking so many filaments that the sheets were seriously weakened. By means of the present invention, layers of spunbonded sheeting, partially or fully bonded, can be combined into composite structures with strong adhesion between the layers and without breaking the filaments. This invention provides a capability to use a completed, spunbonded, sheeting product in the manufacture of a composite product without need for any specially-made substrate sheeting and, after needle-punching, will have high strength and low tendency to delaminate.

In practice of this invention, any thermal-bonded, nonwoven, sheeting material can be used. Examples of such material are: spunbonded polypropylene of about 10 to 20 denier per filament such as sold under the trademark "Typar" by E. I. du Pont de Nemours International, S.A., Geneva, Switzerland; polyester of about 12 denier per filament such as sold under the trademark "Lutradur" by Lutravil Spinnulies, GmbH, West Germany; spunbonded sheath/core nylon 6/polyester of about 10 denier per filament such as sold under the trademark "Colback" by Akzo, N.V., Arnhem, The Netherlands; spunbonded polypropylene such as sold under the trademark "Tekton" by Reemay, Inc., Old Hickory, TN, USA; and spunbonded polypropylene and polyethylene such as sold under the trademark "Terram" by Exxon, Pontipool, Gwent, Great Britain. The preferred material and the material to which this invention is most directed, is spunbonded polypropylene such as is described in U.S. Pat. No. 3,563,838, issued Feb. 16, 1971 on the application of C. E. Edwards.

Combinations of such thermal-bonded, nonwoven, materials can be used; and the thermal bonding can be of a low or high degree.

Spunbonded sheeting is made by melt spinning continuous fibers onto a moving laydown belt to provide a predetermined orientation in, both, machine and transverse directions. The bonding is accomplished by application of heat and pressure. It is important to understanding of this invention to know that the webs which are to be used in this composite structure are spunbonded and that the filaments of a web are individually bonded to other filaments in that web. It has been found, in the past, that such spunbonded webs, which have been joined by means of the usually-used needle-punching, have a harsh hand and little strength. When regular spunbonded webs having interfilament connections are joined by the barbed needle-punching, the fibers are broken and there is very little surface-to-surface intermingling of filaments beyond the enmeshing which is forced by the action of the barbed needles.

By the present invention, as will be described below, treatment of the webs prior to the barbed needle-punching results in composite structures which are soft and have strong lamination forces and tensile properties which are substantially undiminished by the lamination operation.

Spunbonded webs which can be used in practice of this invention can be made from any of the aforementioned materials, and combinations of those materials; and they can be of any basis weight ranging from less than 20 grams per square meter to more than 200 grams per square meter.

A special application for the present invention is in providing a use for spunbonded sheeting of secondary quality such as sheeting material which did not pass the first grade quality testing but which can be used for a composite application even though the sheeting has surface filaments which have been bonded together.

Staple fibers, if used, can be of polyester, polyolefin, polyamide, or other synthetic fiber material, natural fiber material, or combinations of synthetic and natural fibers. It is preferred that staple fibers should be crimped although such is not necessary for practice of the invention.

A scrim can be used in the place of staple fibers. Use of scrim as an additive material has been found to significantly improve the strength of the product. One scrim product which has been used is a combination of machine direction and transverse direction polyethylene terephethalate yarns knitted on the crosses with twisted polyethylene terephthalate yarn. Such a scrim is sold under the trademark "Notex" by Notex , Pontcharra-sur-Turdine, France. As has been pointed out, the spunbonded web is needled with smooth needles prior to needle-punching with barbed needles. The needling causes most filament-to-filament bonds to be broken so that fiber can move freely and thereby come into a closer association with the adjacent material.

In order to avoid excessive filament breakage during the preliminary needling, a lubricating finish is applied to the spunbonded web. The lubricating finish generally includes a silicone oil; but can be any of polysiloxane, polypropylene oxide, polyoxyethylene laureate, polyalkylene glycol, glycol ester or the like or any combination of any of those materials. A copolymer of dimethyl polysiloxane and polypropylene oxide is the preferred finish for practice of this invention.

The finish can be applied to the spunbonded webs in any manner. It is usually applied by contact of the web with a gravure roll which applies a controlled amount of a solution or dispersion of the finish material; but any other means will suffice. The web can be sprayed with a solution of the finish material or the finish material can be applied by any other acceptable process.

The solutions or dispersions of finish material are usually aqueous although other liquid solvents or carriers can be used. The concentration of finish material in the liquid is usually 0.5 to 3.0 percent, by weight.

The size and shape of the smooth needles is critical to practice of this invention. Needles which have been used to advantage have been about 7.5 cm long, have a taper from point-to-root of about 16 degrees, have a root diameter of 2.8 mm, and have ball points. The smooth needles are generally mounted in plates having 1000 to 7500 needles per linear meter and the spunbonded webs are needled in a concentration of 50 to 300 stitches per square centimeter. Of course, the exact degree of needling which is necessary will vary with the kind and thickness of spunbonded web which is used. This needling step can be performed on only one side or on both sides, if desired.

It has sometimes been found advantageous to smooth-needle the webs more than once;-- the first time using very fine needles and subsequent times using larger needles. The object of the smooth-needling step is to debond or break filament-to-filament bonds without breaking the filaments themselves.

Loosening the webs by means of smooth needles has been found to provide advantages over other filament loosening means, such as stretching the webs or passing the webs through localized stretching devices known as button breakers. The smooth needles can be mounted on the same machine with the barbed needles and the web loosening can be accomplished immediately prior to the barbed needle-punching, thus, eliminating any difficulty in handling the loosened web before the barbed needle-punching step.

Needled webs can be placed in a stack without more or the needled webs can be accompanied in the stack by other materials - both webbed and not. The needled webs can be placed such that all run in the same direction, that is, all in the machine direction or all in the cross or tranverse direction, or they can be placed to run in different directions. The needled webs can be of different materials and of different basis weights; and there can be as many of the webs as are desired or required for any particular use. The needled webs can be used to envelop a filler of material such as binder fibers, conductive fibers, or fibers or other materials coated with or containing an additive such as a sustained or slow release chemical agent.

The smooth-needled webs, placed into a stack, are needle-punched using barbed needles to mechanically enmesh the filaments from one of the webs to others of the webs. In order to accomplish symmetrical enmeshment, the barbed needle-punching should be conducted from both sides of the composite structure.

A wide range of needles can be used in the barbed needle-punching step. Commercially available needle plates can be used with usually-used barbs. The barbed needles are usually 7.5 about to 10 cm long, 0.4 to 2.3 mm in diameter, with 1.3 to 6.3 mm from barb-to-barb and are arranged on plates having 1000 to 7500 needles per linear meter. Needles identified as 15*18*36*3RB30 A06/10, as obtained from Singer Spezialnadel-fabric, GmbH, Wurselen, Germany, are satisfactory.

The web stacks are generally needle-punched in a concentration of 150 to 500 stitches per square centimeter. The particular degree of needle-punching which is necessary will vary with the kind and thickness of the stack which is to be punched.

While the preceding steps have been described individually, it is more efficient and preferable to conduct all of the steps in one pass on the same piece of equipment or on separate pieces of equipment closely arranged.

Test Procedures.

The following are descriptions for tests which are useful in characterizing the products of this invention.

Basis Weight of a web is measured in accordance with ASTM D 3776-79; but using specimens 21 cm wide and 30 cm long and expressed in grams/square meter.

Thickness is measured in accordance with ASTM D 1777; but at a pressure of 0.05 bar.

Sheet Strip Tensile (SST load and elongation) is measured according to ASTM D 1682 (breaking load and elongation); but done at two different sample widths and jaw separations as given in the Tables which follow. For example, 5*20 is a 5 cm wide sample with a 20 cm jaw separation while 20*10 is a 20 cm wide sample with a 10 cm jaw separation. The test is done in longitudinal or machine direction (MD) and in cross or transverse direction (XD).

Trapezoid Tear is measured according to ASTM D 2263. The test is done in longitudinal direction (MD) and in cross direction (XD).

California Bearing Ratio (CBR) is measured according to Deutsche Industrie Normen (DIN) 54307. A DIN A4 sample is fixed between two clamps with a round opening which leaves a free portion of sample 15 cm diameter. A 5 cm diameter piston with rounded edges (2 mm radius) is then pushed through in the center of the free sample surface at a speed of 10 cm/min. The maximum load expressed in Newtons and the piston penetration required to perforate the same is measured and reported.

Cone Penetration is measured according to the following method. The same sample size and clamping system is used as was used above (CBR); but, in this test, a 1 kg cone with a 45 degree angle on the point (rounded at 2 mm radius), is dropped from an height of 50 cm in the center of the free sample (15 cm diameter). The diameter of the hole caused by the impact is measured using a calibrated cone and is reported in millimeters.

Air Permeability is measured according to ASTM D 737; but with a circular orifice of 10 square cm and at 10 mm water head pressure.

Sheet Grab Tensile (SGT) is measured according to ASTM 1682 and is done in longitudinal direction (MD) and in cross direction (XD).

VTT Rathmeyer. This test, also, uses the same sample size and clamping system as for CBR; but the sample has a 10 mm diameter hole cut in the center. A penetrating piston starts with a cylinder which is 5 cm long and 11 mm diameter and then the diameter expands to 45 mm and this expansion makes an angle of 45 degrees with the cylinder edge. In conduct of the test, the piston is pushed through the hole in the sample at 10.8 mm/min and the following parameters are recorded:

maximum load seen reported in newtons sample deformation (penetration) from beginning of the widening diameter to the maximum load.

friction resistance when the small cylinder penetrates the pre-cut hole.

force at 20 mm piston penetration beyond the diameter widening point.

DESCRIPTION OF THE PREFERRED EMBODIMENTS

EXAMPLE 1: Effect of pre-loosening the fibers by needling with smooth needles.

The spunbonded web used for this test was made from polypropylene of 10–20 denier, such as sold by E. I. du Pont de Nemours International, S.A. under the trademark "Typar" as style 3607 and exhibited extremely low bonding (that is, the filaments came loose very easily on both sides). The low bonding in spunbonded sheeting is achieved by use of reduced temperature and pressure. The basis weight was 190 g/m$^2$ and two sheets were needle-punched together using barbed needles. The spunbonded webs were lubricated with a 1% solution of an alkylpolyglycol ether, a commercial finish used in the needling industry and sold, for instance, by Henkil & Cia., Germany, under the tradename "Selbana 4236".

The loosening was done using smooth needles of 0.55 mm diameter at a stitch density of 300 st/cm$^2$; and the needle-punching was done using Singer needles type 15*18*36*3RB30 A06/10 at a stitch density of 270 st/cm$^2$ and at a needle penetration of 13 mm.

Results of the test are set out in Table 1. The composite using sheets which were loosened in accordance with the invention is compared with the same composite using sheets which were not loosened (Control).

TABLE 1

| | Control | Loosened |
|---|---|---|
| Basis Weight (g/m$^2$) | 386 | 416 |
| Thickness (mm) | 2.9 | 3.0 |
| SST Load (Kg) MD | / | 60 |
| (5*20 cm) XD | / | 13 |
| SST Load (N) MD | 90.0 | 468 |
| (20*10 cm) XD | 22.9 | 294 |
| Trap. Tear (Kg) MD | 12.0 | 57 |
| XD | 4.2 | 45 |
| CBR Load (N) | 763 | 3668 |
| Penetr. (mm) | 50 | 58 |
| Cone Penetr. (mm) | 14 | 15 |
| Air Perm. (m$^3$/m$^2$min) | 61 | 77 |

It is noted that the composite using loosened layers in accordance with the present invention exhibits extraordinary increases in strength.

EXAMPLE 2: Effect of the finish.

The substrate used was the same as in Example 1 and two layers were used in each case. All of the substrate layers were pre-loosened as in Example 1 and so, also, were needle-punched in the same way.

Finish A was a 1% solution of a copolymer of dimethyl polysiloxane and polypropylene oxide such as is sold by Dow Corning Corporation under the trade designation R-1248 Fluid, and Finish B was the same as in Example 1, above.

TABLE 2

| | No Finish | Finish A | Finish B |
|---|---|---|---|
| Basis Weight (g/m$^2$) | 407 | 418 | 416 |
| Thickness (mm) | 2.9 | 3.0 | 3.0 |
| SST Load (Kg) MD | 5.0 | 60.0 | 60.0 |
| (5*20 cm) XD | 5.0 | 15.0 | 13.0 |
| Trap. Tear (Kg) MD | 5.0 | 74.0 | 71.0 |
| XD | 7.0 | 45.0 | 34.0 |
| CBR Load (N) | 300 | 4303 | 3668 |
| Cone Penetr. (mm) | 39 | 17 | 17 |
| Air Perm. (m$^3$/m$^2$min) | 78 | 78 | 77 |

It is noted that use of a finish yields dramatic increase in load and strength test values.

EXAMPLE 3: Effect of addition of a layer of 50 g/m$^2$ of staple yarn.

The substrate used was the same as in Example 1, with the same finish, and with two layers being used. An additional layer of staple was made from commercial grade polyester staple yarn with medium bulk, 7 denier, and 5–6 cm length.

The substrate layers were pre-loosened and needle-punched as in Example 1 and the staple was added on the top of the two substrate layers.

The visual aspect of the product was very good and the delamination resistance very high as indicated by the fact that the layers could not be separated into their original structures.

TABLE 3

| | Staple Alone | Substrate Alone | Composite (Substrate + Staple) |
|---|---|---|---|
| Basis Weight (g/m$^2$) | 50 | 416 | 480 |
| Thickness (mm) | 1.2 | 3.0 | 4.04 |
| SST Load (Kg) MD | 8.0 | 60 | 145 |
| (5*20 cm) XD | 8.0 | 13 | 90 |
| Trap. Tear (Kg) MD | 3.0 | 71 | 84 |
| XD | 4.0 | 34 | 57 |
| CBR Load (N) | 150 | 3668 | 4770 |
| Cone Penetr. (mm) | 48 | 15 | 10 |
| Air Perm. (m$^3$/m$^2$min) | 200 | 77 | 51 |

Addition of the staple layer significantly increased the load and strength test values.

EXAMPLE 4: Effect of the diameter of the smooth needles.

The substrate used was a regular 136 g/m$^2$ spunbonded polypropylene sheet sold by E. I. du Pont de Nemours International, S.A. under the tradename Typar as Style 3407. The substrate was lubricated with Finish A from Example 2, above, and two layers of the substrate were needle-punched together. The pre-loosening was accomplished by using smooth needles with the diameter given below and at a stitch density of 200 st/cm$^2$. The needle-punching was conducted using the same needles as in Example 1, at the same stitch density but at a needle penetration of 14–15 mm (14 mm from the top and 15 mm from the bottom).

TABLE 4

| | | |
|---|---|---|
| Smooth Needle diam. (mm) | 1.1 | 2.8 |
| Substrate Basis Wt. (g/m$^2$) | 290.7 | 285.9 |
| SST Load (N) MD | 1167 | 1839 |
| (20*10 cm) XD | 673 | 1246 |
| Trap. Tear (Kg) MD | 22.6 | 28.4 |
| XD | 12.6 | 21.7 |
| CBR Load (N) | 1250 | 2036 |
| Penetr. (mm) | 49 | 60 |

The larger smooth needles yield more completely loosened substrate fibers and result in needle-punched products of greatly increased load and strength values.

EXAMPLE 5: Effect of the stitchy density.

The substrate used was two layers of 100 grams per square meter spunbonded polypropylene sheet sold by E. I. du Pont de Nemours International, S.A. under the tradename "Typar" as Style 3308. the substrate was lubricated with Finish A from Example 2. The pre-loosening was conducted using smooth needles with a diameter of 0.55 mm, at a stitch density of 270 st/cm$^2$ and the needle-punching was conducted using the same needles as in Example 1 but at the stitch densities specified in the Table below and at a needle penetration of 14 mm.

TABLE 5

| | | | |
|---|---|---|---|
| Stitch density (st/cm$^2$) | 270 | 500 | 700 |
| Basis Weight (g/m$^2$) | 218 | 223 | 236 |
| Thickness (mm) | 1.98 | 2.02 | 1.99 |
| SST Load (Kg) MD | 14 | 28 | 31 |
| (5*20 cm) XD | 14 | 29 | 34 |
| SST Load (N) MD | 910 | 1240 | 1490 |
| (20*10 cm) XD | 970 | 1180 | 1390 |
| Trap. Tear (Kg) MD | 10 | 17 | 19 |
| XD | 15 | 20 | 20 |
| CBR Load (N) | 1445 | 1047 | 1208 |
| Penetr. (mm) | 55 | 56 | 65 |
| Cone Penetr. (mm) | 15 | 21 | 23 |
| Air Perm. (m$^3$/m$^2$/min) | 105 | 98 | 86 |

Increased needle-punching stitch density appears to improve the load and strength values, somewhat.

EXAMPLE 6: Combination of more than two spunbonded substrate sheets needle-punched together.

The substrate used was the same material as was used in Example 5 and was lubricated with Finish A from Example 2. The pre-loosening was conducted using smooth needles with a diameter of 1.1 mm, at a stitch density of 220 st/cm$^2$ and the needle-punching was done using the same needles as in Example 1 but at 220 st/cm$^2$ and at a needle penetration of 14–15 mm (14 from the top and 15 from the bottom).

TABLE 6

| Number of Substrate Layers | 3 | 4 | 5 |
|---|---|---|---|
| Basis Weight (g/m$^2$) | 300 | 400 | 500 |
| Thickness (mm) | 2.4 | 2.8 | 3.2 |
| SST Load (Kg) MD | 28 | 41 | 54 |
| (5*20 cm) XD | 33 | 50 | 68 |
| SST Load (N) MD | 1470 | 2020 | 2570 |
| (20*10 cm) XD | 1590 | 2250 | 2900 |
| Trap Tear (Kg) MD | 16 | 21 | 27 |
| XD | 24 | 32 | 40 |
| CBR Load (N) | 1720 | 2340 | 2960 |
| Penetr. (mm) | 54 | 55 | 56 |
| Cone Penetr. (mm) | 15 | 11 | 9 |
| Air Perm. (m$^3$/m$^2$min) | 91 | 70 | 49 |

I claim:

1. A process for manufacturing a composite structure of spunbonded layers comprising the steps of:

(a) applying a finish of lubricating material to coat the filaments of a spunbonded web of synthetic polymer;

(b) needling the web of coated filaments using smooth needles to break bonds between the filaments;

(c) placing at least one needled web of coated filaments from step (b) in a stack; and (d) needle-punching the stack with barbed needles to enmesh filaments from the spunbonded webs and yield a composite structure of layers.

2. The process of claim 1 wherein the needling of step (b) is conducted at a concentration of 50 to 700 stitches per square centimeter.

3. The process of claim 1 wherein the spunbonded web of step (a) has a basis weight of 20 to 300 grams per square meter.

4. The process of claim 1 wherein the synthetic polymer is selected from the group consisting of polypropylene, polyethylene, polyester, polyamide, and combinations of those polymers.

5. The process of claim 1 wherein the lubricating material is selected from the group consisting of polysiloxane, polypropylene oxide, polyoxyethylene laureate, polyalkylene glycol, and glycol ester.

6. The process of claim 1 wherein at least two needled webs are placed in a multi-layer stack.

7. A composite structure of spunbonded layers comprising:

(a) at least two loosened webs of spunbonded polymer filaments wherein the filaments of each web have a coating of a lubricating material and have at least some of the bonds between the filaments broken in order to loosen the web; and (b) at least some filaments from each of the loosened webs are enmeshed with filaments of the other loosened web to join the webs.

8. The composite struction of claim 7 wherein a layer of staple fibers is present between two of the loosened webs.

* * * * *